United States Patent [19]

Phillips

[11] Patent Number: 4,572,547

[45] Date of Patent: Feb. 25, 1986

[54] MULTI-FUNCTION TICKLER FILING SYSTEM

[76] Inventor: Geoff Phillips, 7248 Arpege Rd., San Diego, Calif. 92119

[21] Appl. No.: 544,631

[22] Filed: Oct. 24, 1983

[51] Int. Cl.[4] ..... B42F 21/00; B42F 17/00; G09D 3/00

[52] U.S. Cl. ..... 283/36; 312/183; 40/107

[58] Field of Search ..... 283/3, 36, 37, 67, 79; 312/183, 234.5, 185, 193; 40/107, 371, 372

[56] References Cited

U.S. PATENT DOCUMENTS

| | | | |
|---|---|---|---|
| 1,153,761 | 9/1915 | Carrill | 312/183 |
| 1,200,348 | 10/1916 | Hawk | 40/107 |
| 1,435,664 | 11/1922 | Russell | 283/36 |
| 1,683,468 | 9/1928 | Jonas | 283/36 |
| 1,685,011 | 9/1928 | Wood | 312/183 |
| 1,931,224 | 10/1933 | Herz | 312/234.5 |
| 3,911,609 | 10/1975 | Baya | 43/26.1 |
| 4,178,019 | 12/1979 | Gedzelman | 40/107 |
| 4,196,949 | 4/1980 | Easton | 312/183 |

*Primary Examiner*—Paul A. Bell
*Assistant Examiner*—Paul M. Heyrana, Sr.
*Attorney, Agent, or Firm*—Frank D. Gilliam

[57] ABSTRACT

The invention is directed to a method of alerting a person to a date of a future event prior to the date of that event. The method utilizes a container in which are placed day of the month numbered cards and month of the year cards in sequential order in a suitable container. File cards are filled out as required indicating the subject matter and the date of an event directed to that subject matter occurring at a future time and date. These file cards are placed sequentially in the front of the month of the year cards according to the month in which the future event falls. In the case of the current month, the day of the month cards are employed and the file cards with a future date falling within the current month are placed in front of the day of the month card with the corresponding date. The current and past day of the month cards for the current month are placed either behind the last day of the month card or in front of the month of the year card following the current month. On the last day of the month the current month of the year card is moved to a position behind the last month of the year card along with or prior to any file cards with future dates falling within that month next year. An alphabetical file is maintained to store retired future event file cards according to desired subject matter.

8 Claims, 2 Drawing Figures

MULTI-FUNCTION TICKLER FILING SYSTEM

BACKGROUND OF THE INVENTION

The present invention relates to filing systems, and in particular to a future event memory recall filing system commonly referred to as a "tickler" system which additionally includes subject matter information. The word "tickler" in Webster's New Collegiate Dictionary is defined as: "A device for jogging the memory; specifically: a file that serves as a reminder and is arranged to bring matters to timely attention."

An early U.S. Pat. No. 1,200,348 by Walter Hawk inventor taught using a calendar type device in the form of a cabinet having forty nine numbered compartments or pigeon holes. Thirty one of the compartments or pigeon holes corresponding to the day and date of a current month. Various daily and monthly expenses of a household are organized according to days/dates.

U.S. Pat. No. 1,601,119 by inventor J. A. Heaton teaches a memorandum calendar constructed and arranged so as to receive and support memorandum slips or cards at desired specific dates for an entire year.

U.S. Pat. No. 3,911,606 by inventor Hunkins teaches a calendar kit especially adopted to provided reminders of selected dates. The kit includes a backing sheet having T shaped reminder tabs formed therein on perforation lines, and a plurality of calendar sheets each having horizontal slits associated with respective date spacers. The kit is used by first separating one of the reminder tabs from the backing sheets along the perforation lines, and then inserting the lower portion of the reminder tab into the slit associated with the selected date space on a calendar sheet. The exposed upper portion of the reminder top provides a visible reminder of an event associated with the selected date.

Loose leaf desk calendar and large monthly desk calendars have been long utilized to remember the dates of future events.

All of the above mentioned methods of remembering dates of future events and others have met with a certain degree of success; however, there is always a need for a further advancement and improvements in the age old problem of remembering dates of future events and details past and present relating to those events. The present invention provides further advancements and improvements in this art.

SUMMARY OF THE INVENTION

In this invention, a file container is provided which is utilized to contain the components of a perpetual tickler filing system comprising a plurality of file cards which contain detailed information directed to a chosen subject, such as, a salesman's client and particularly related to that client or entity and a date in the future for an action with that client or entity; thirty-one daily divider cards numbered for the maximum number of days of the month; and monthly divider cards indicating the months of the year; i.e. January, February, etc.

The monthly divider cards are positioned in the container sequentially from the current month to the last month of the year with the monthly divider cards of past months placed sequentially positioned behind the last month of the year monthly divider card.

The daily divider cards are placed into the container to the front of the monthly divider cards in sequential order from the day following the current date to the last numbered daily divider card with the current and past dated daily divider cards in sequential order positioned either behind the last numbered daily divider card or behind the current month divider card.

The file cards with subject matter information and future need date requirements (future event information file cards) are filed sequentially in front of the monthly divider cards of their respective future months. Those falling within the current month are positioned in front of the daily date card of their need date. As the future date becomes a current date, the future event information file card either now has a new future need date established and accordingly is positioned in a future date position or is retired either temporarily or permanently in an alphabetical file in the rear of the container according to name, subject matter, etc., either for future use or as a permanent record of past events related to that subject.

An object of this invention is the filing of information specifically by function occurring on a certain date as opposed to filing information at a date when the event occurred.

Another object of this invention is to provide a substantially fool proof memory system for alerting a person for action on a certain future date before that date.

A further object of this invention is to provide a chronological history of events directed to a specific action.

Further objects and advantages will become apparent from the following description and claims and from the accompanying drawings.

BEST MODE FOR CARRYING OUT THE INVENTION

Figure 1:
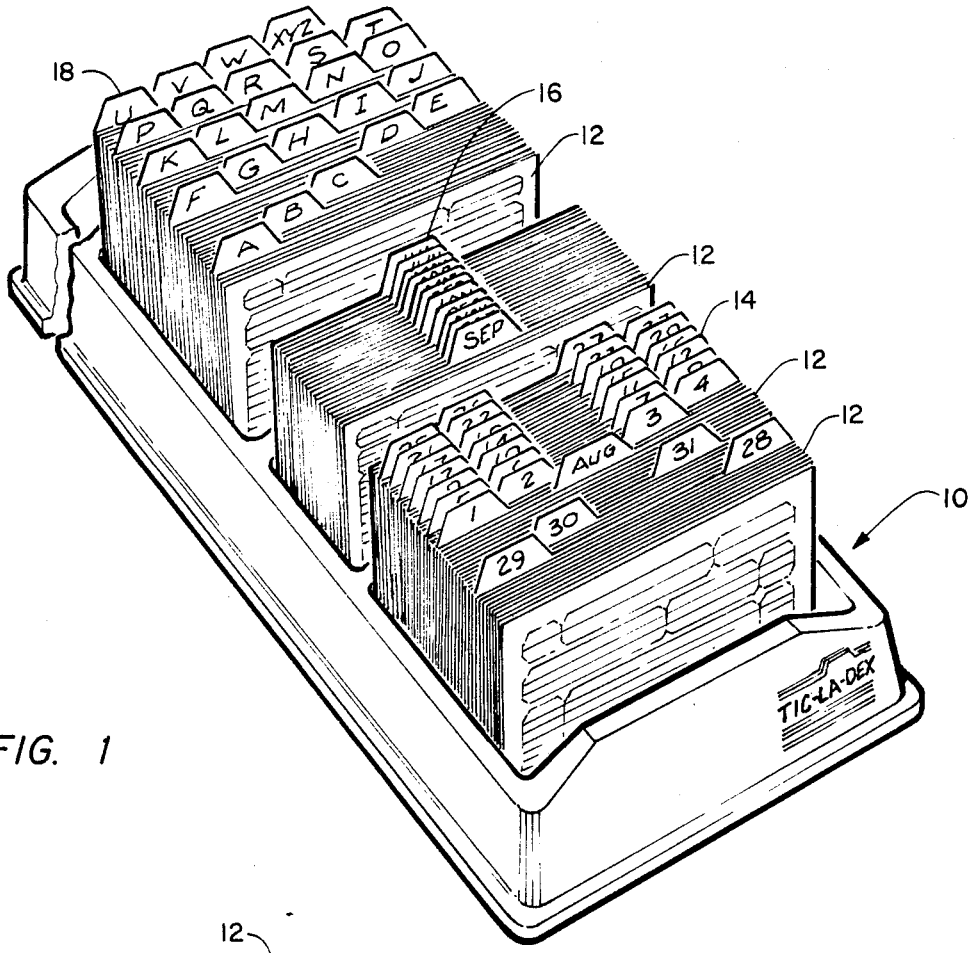
FIG. 1 is a cutaway side view of the container including the placement therein of the various file and divider cards of the invention.

Referring now to the drawings, FIG. 1 illustrates a perspective view of the container 10 of the present invention. The container 10 may take any form that is suitable for containing the various file and divider cards of the invention and their daily manipulation as set forth hereinafter.

Figure 2:
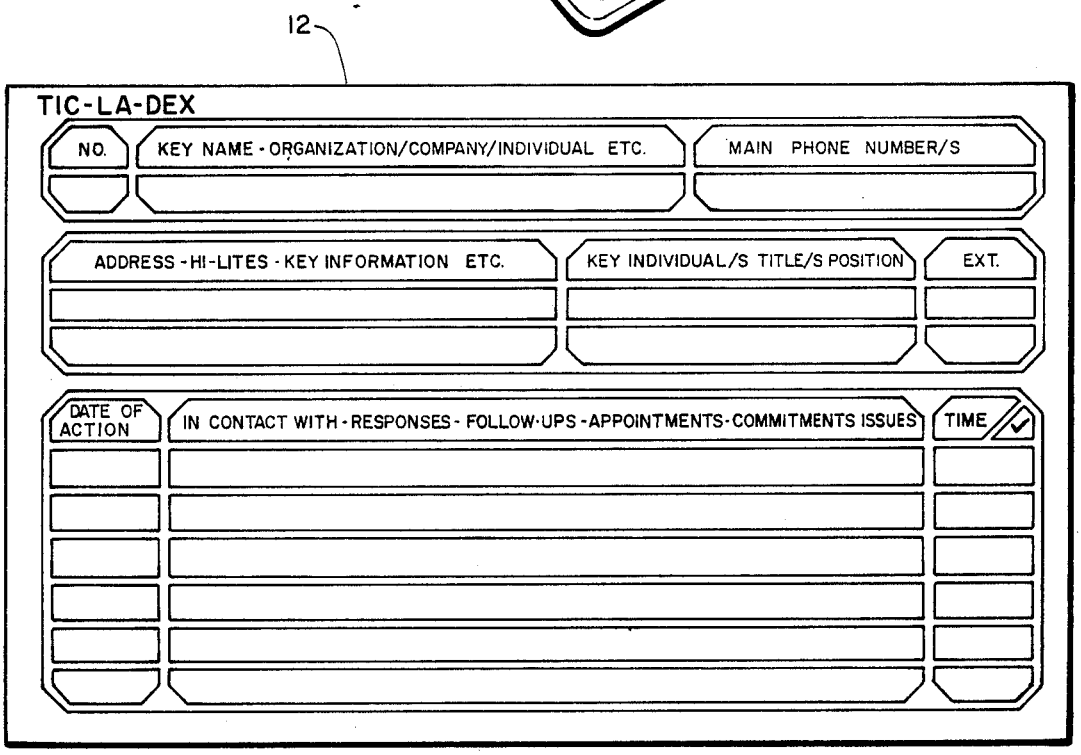
FIG. 2 is a showing of the front of a future date file card.

The invention utilizes a plurality of future event information file cards 12. A typical future event information file card 12 is shown in FIG. 2 in specific detail. The form of the card 12 shown should not be considered the only form that can be utilized to practice this invention. Any convenient form could be used equally as well.

Thirty-one numbered daily date cards 14 are used to identify a particular calendar date.

Twelve month of the year cards 16 having the month of the year thereon are also utilized.

An optional feature is an alphabetical index file utilizing cards 18 each representing at least one letter of the alphabet.

Preferrably the identifying tabs of the daily date and month of the year cards extend above the upper rectilinear surface of their respective card and are arranged so that at least four assending daily dates are visible and a month identifying tab is visible from the front of the container. The month identifying tab is positioned in the center of the visible tabs. Other different arrangements of identifying tabs may also be used to practice the invention.

Suitable spacing means may be positioned between the various groups of index cards and divider cards as shown for convenience. The spacing means, however, does not form a part of this invention.

METHOD OF OPERATION

The monthly divider cards 16 are positioned within the container 10. The monthly divider cards 16 are arranged so that the current month, for example, assume the month to be August, is foremost in the stack or deck of monthly divider cards. The remaining months of the year are sequentially positioned behind the August identified monthly divider card, i.e., September, October, November and December. The monthly divider cards of past months are positioned sequentially behind the December monthly divider card, i.e., January, February, April, May, June and July.

Positioned in front of the August monthly divider card are the daily date cards 14. The daily date cards 14 are positioned sequentially with the day of the month following the current date positioned front most, i.e., in front of the entire remaining file or divider cards. For example, the current date of August is the 27th, therefore, the card showing is for the 28th. The current or past daily date cards 14 are positioned sequentially by increasing numbers either behind the daily date card indicating the thirty-first or in front of the following months of the year card. Either method of positioning the current and past daily date cards may be utilized to practice this invention. The selection of methods is a selection by the user.

The future event information file cards 12 having a future date use requirement are now filed in the container. The future event information file cards 12 are filed in increasing date sequence in front of their needed month. In the instance of the current month, for example, August, those future event information file cards 12 having a future event date occurring on the 28th would be filed in front of the front daily date card 14 for the 28th. Those having future need dates in August would be positioned in front of their corresponding date daily date card.

In the instance where the user selects to place the current and past daily date cards 14 behind the date card for the 31st, the future event information file cards 12 for the following month are either filed in front of the monthly divider card 16 as is done for each of the future months of the year or are positioned in front of the past date daily date cards 14. In any event before the last day of the current month the future date information cards should be positioned in front of the daily date cards and the daily date cards positioned sequentially in front of the following month, i.e., September.

If the user chooses to move the current and past date cards to the front of the following month of the year card, i.e., September, then the future date information cards with future dates in September could be filed in front of the current and past date cards as these cards accumulate.

After the future event information card reaches the day before its use date, it can either be moved ahead to other future dates or if no longer needed can be moved to an optional alphabetical file for further reference.

A sales person, for example, sets up an appointment to contact a buyer on a certain date in the future. On making the first appointment for that contact the sales person fills out a future date information file card 12 noting all pertinent information available, i.e., name, address, phone number, etc. The date of the future contact is indicated on the card and the card is filed according to the aforementioned procedure. The day before that future date, that future date card will be positioned in front of the foremost daily date card 14 visible to the sales person. The sales person may remove that future date card from the file at a convient time to execute its function as required. The following day at the time indicated on the card, the sales person makes his contact with the buyer. If during the contact an event triggers something that requires a future contact by the sales person then that future date reminder card is refiled in the container according to the aforementioned scheme of filing. However, before refiling the sales person would enter all information related to that past contact which the sales person feels should be remembered, i.e., what the buyer ordered, future needs, etc. If for some reason the contact with the buyer did not necessarily require a future contact the card would be filed in the optional alphabetical file behind or in front of the appropriate file card 18 for future use or reference.

Although this method of remembering a date of a futue event and the details occurring on those chosen dates directed to that event will be partially useful for sales personnel; it should be understood however, that this use is not intended to place any limitation on the invention.

Obviously any number of future date cards can be filed in the container in the manner aforementioned.

While a particular embodiment of the present invention has been illustrated and described herein, it is not intended to limit the invention to such disclosure, but changes and/or additions may be made therein and thereto without departing from the invention as set forth in the following claims.

I claim:

1. A perpetual method of keeping track of a plurality of different dates for separate future events comprising a container, having a front and back, a plurality of future event information file cards each indicating a past, current or future event of a specific subject matter, and the date thereof, daily divider cards numbered one through thirty-one corresponding to the date of the days of the month and monthly divider cards each identified with a month of the year, said method comprising:

(a) positioning the monthly divider cards in the container sequentially from the current month to the last month of the year, said monthly divider cards of past months of the year are positioned sequentially behind the last month of the year monthly divider cards, (b) positioning in the container in front of the monthly divider cards sequentially from front to back the daily divider card representing the day following the current day to the thirty-first day, said daily divider cards representing the current and past days of the current month are positioned sequentially behind the current monthly divider card, (c) placing said future event information file cards having an event with a future date falling after the current date within the current month in front of the daily divider card indicating the date on which that future event falls, (d) placing said future event information file cards which have a future event falling on a date after the month following the current month in front of the monthly divider card for the month in which the future event occurs, (e) placing said future event information file cards having an event date falling within the month following the current month sequentially in front of the daily divider cards indicating the day of the month of that future event prior to the last day of the current month, and, (f) moving the current month of the year card from the front of the container to a position behind the last positioned month of the year card on the last day of the current month.

2. The method of claim 1 wherein there additionally comprises alphabetical divider cards and retired future event information file cards are filed therein according to an alphabetical designator directed to its subject matter whereby said retired future event information file cards may be reused to indicate an additional future event directed to the same subject matter thereon.

3. The method as defined in claim 1 wherein the following step is substituted for step (b), positioning the daily divider cards indicating the current and past days of the month sequentially behind the card indicating the thirty-first day of the month and the dates of future events occurring within the next months following the current month in the front of the monthly divider card indicating the corresponding future month.

4. A filing system for keeping track of a plurality of different dates for separate future events comprising:

a container having a front and back;

a plurality of future event information file cards each indicating an event of a specific subject matter and the date thereof;

daily divider cards numbered one through thirty-one inclusive corresponding to the date of the days of the month; and monthly divider cards each identified with a month of the year, said monthly divider cards are positioned in said container sequentially from the current month to the last month of the year, said monthly divider cards of past months of the year are positioned sequentially behind the last month of the year monthly divider card, said daily divider cards are positioned in front of the monthly divider cards sequentially increasing number order from front to back with the daily divider card representing the day following the current day to the thirty-first day, said daily divider cards representing the current and past days of the current month are positioned sequentially behind the current monthly divider card or behind the card indicating the thirty-first day of the month, said future event information file cards with a future event date falling after the current date of the current month are placed in front of the daily divider cards indicating the date on which that future event falls, placing the future event information file cards which have a future event falling on a date after the current month in date sequence in front of the monthly divider card for the month in which the future event occurs and placing the future event information file card having an event date falling within the month following the current month either sequentially in front of the next month monthly divider card or in front of the current month past date cards.

5. The invention as defined in claim 4 wherein there additionally comprises an alphabetical file positioned behind the last monthly divider card for storage of said future event information file cards having no future date requirements.

6. The invention as defined in claim 4 wherein spacers are utilized to maintain the file components in an upright use position.

7. The invention as defined in claim 4 wherein said daily divider cards and monthly divider cards have upwardly extending tabs which are arranged so that at least four sequentially assending dates are visible and a monthly divider card is visible.

8. The invention as defined in claim 7 wherein the tab of said monthly divider card is centrally visible between the tabs of said daily divider cards.

* * * * *